United States Patent [19]

Sato et al.

[11] 4,149,952

[45] Apr. 17, 1979

[54] ELECTROLYTIC CELL

[75] Inventors: Kimihiko Sato; Yasuo Sajima; Toshihiko Kuno, all of Yokohama; Harumi Ohbe, Tokyo, all of Japan

[73] Assignee: Asahi Glass Co. Ltd., Tokyo, Japan

[21] Appl. No.: 830,145

[22] Filed: Sep. 2, 1977

Related U.S. Application Data

[63] Continuation-in-part of Ser. No. 677,257, Apr. 15, 1976, Pat. No. 4,069,129.

[51] Int. Cl.[2] ..... C25B 9/00

[52] U.S. Cl. ..... 204/258; 204/266

[58] Field of Search ..... 204/254, 256, 268, 286, 204/257, 258, 266

[56] References Cited

U.S. PATENT DOCUMENTS

| | | | |
|---|---|---|---|
| 3,775,283 | 11/1973 | Eisele et al. | 204/268 |
| 3,778,362 | 12/1973 | Wiechers et al. | 204/254 |
| 3,836,448 | 9/1974 | Bouy et al. | 204/286 |
| 3,926,770 | 12/1975 | Hoekje | 204/254 |
| 4,051,009 | 9/1977 | Schweickart et al. | 204/268 |
| 4,069,129 | 1/1978 | Sato et al. | 204/266 |

*Primary Examiner*—R. L. Andrews

*Attorney, Agent, or Firm*—Oblon, Fisher, Spivak, McClelland & Maier

[57] ABSTRACT

A filter-press type electrolytic cell comprises alternatively arranging quadrilateral frames and ion-exchange membranes to form alternatively anolyte compartments and catholyte compartments under fastening the frames wherein said frame comprises hollow member for path of liquid and gas which has inlet or outlet at the outer surface thereof and holes at the inner surface thereof and a gas-liquid separator whereby each type of electrolytes is passed into an anolyte or catholyte compartment formed in the frame and the electrolyzed product is discharged from the anolyte or catholyte compartment.

6 Claims, 16 Drawing Figures

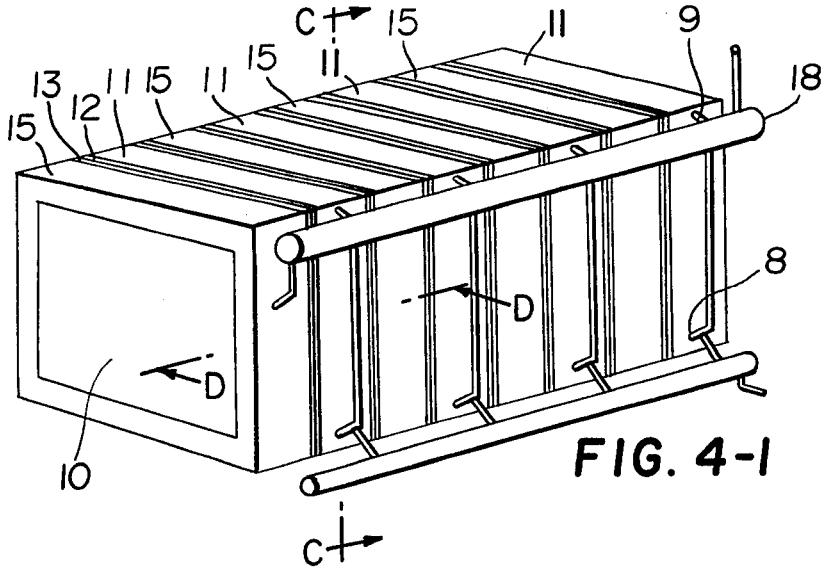
FIG. 4-1
FIG. 4-2
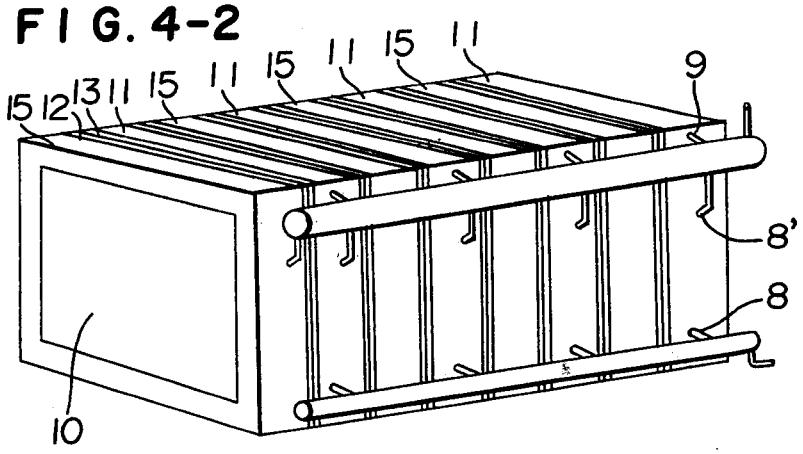
FIG. 6
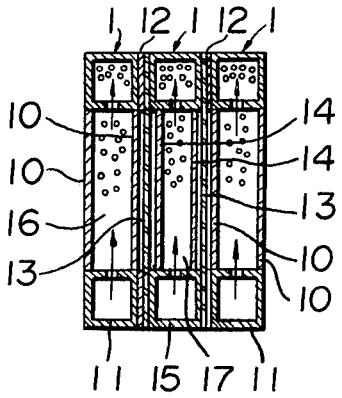

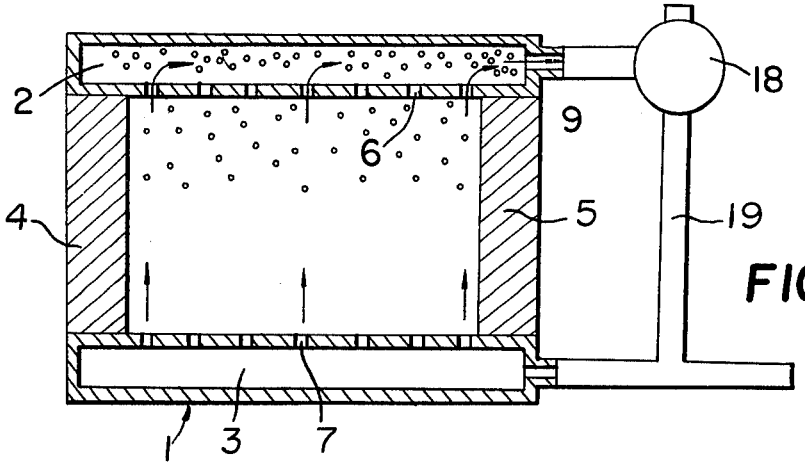
FIG. 5-1
FIG. 5-2
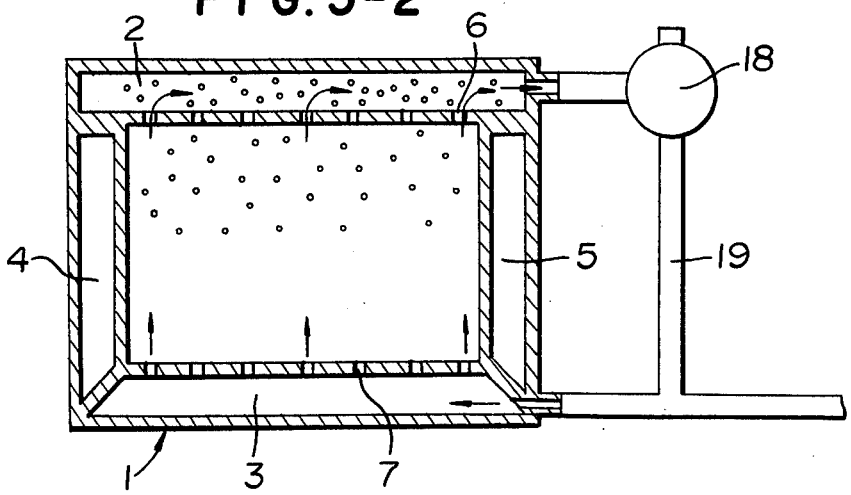
FIG. 5-3
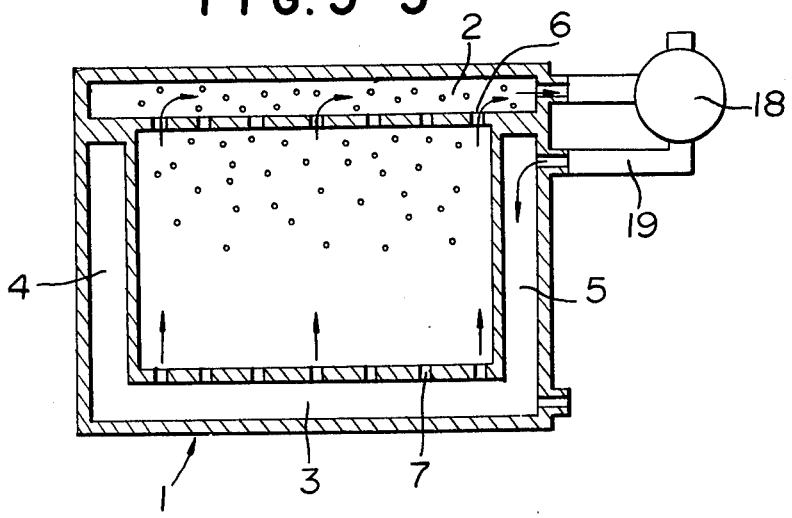

ELECTROLYTIC CELL

This application is a continuation in part of Ser. No. 677,257, filed Apr. 15, 1976, now U.S. Pat. No. 4,069,129.

BACKGROUND OF THE INVENTION:

1. Field of the Invention:

The present invention relates to a filter-press type electrolytic cell formed by alternatively arranging the frames and the ion-exchange membranes and fastening them.

More particularly, it relates to a filter-press type electrolytic cell for producing caustic alkali by an electrolysis of an aqueous alkali metal salt such as an alkali metal chloride.

More particularly, it relates to a filter-press type electrolytic cell wherein a saturated solution of sodium chloride or like is fed into the anolyte compartment and water or a dilute solution of sodium hydroxide is fed into the catholyte compartment, and the electrolysis is attained to obtain chlorine and a dilute solution of sodium chloride from the anolyte compartment and to obtain a concentrated solution of sodium hydroxide (20 to 40 wt.%) and hydrogen gas from the catholyte compartment.

2. Description of the Prior Art:

In the electrolytic cell which is one of the filter-press type electrolytic cells, the frames having an anode, the ion-exchange membranes and the frames having a cathode are alternatively arranged and fastened to form anolyte compartment and catholyte compartment which are respectively partitioned with the membrane.

A solution should be fed and discharged through the frames for the electrolytic compartments such as the anolyte compartments and catholyte compartments, in the operation of electrolysis.

The frames for the conventional electrolytic cell are formed by plates made of synthetic resin having a central opening and a plurality of surrounding holes so as to communicate the corresponding holes in alignment for the compartments in the case of arrangement and fastening of the frames and have groove for communicating the holes and the electrolytic compartments, as disclosed in U.S. Pat. No. 3,869,375; U.S. Pat. No. 3,017,338 and U.S. Pat. No 3,933,617. When the solution is fed to the electrolytic compartment or is discharged from it, the solution is passed into the holes communicating through the frames at the bottoms of the frames and is fed through the groove to the electrolytic compartments. The electrolyzed solution or gas is passed through the groove into the holes communicating through the frames at the upper parts of the frames and is discharged through the communicating holes.

In order to form said grooves and holes on the frames, high processing accuracy and complicated processing operation are required and the work is not easy and the cost is expensive.

It is disadvantages to use block type frames made of anticorrosive metal from the viewpoints expense and weight.

In the ion-exchange membrane electrolysis, the heat is generated by the electric resistance of the solution and the ion-exchange membrane in the compartments during the electrolysis whereby the liquids in the compartments are heated to about 80° to 120° C. It is required to use the frames which are heat resistance to prevent the deformation. In the case of the ion-exchange membrane electrolytic cell, the frames made of the synthetic resin is not suitable, and the frames made of superior metal should be used.

The frame of the filter-press type electrolytic cell using asbestos fabric has been known in U.S. Pat. No. 3,836,448. In the frame, the upper zone(2) for gas-liquid separation is formed at the upper part of the frame. The channels(5) are formed at the both side parts and lower part of the frame. The upper zone(2) is connected to the channels.

As shown in FIG. 2, the electrolyte is fed from the compartment to the upper zone wherein the gas is separated and the liquid is recycled through the channel to the compartment. From the viewpoint of whole of the electrolytic cell, the saturated aqueous solution is fed into the anolyte compartment to be electrolyzed. The most of the solution is fed through the asbestos membrane into the catholyte compartment. From the catholyte compartment, an aqueous solution containing sodium hydroxide and sodium chloride is discharged.

The channel(5) of the side part of the frame is fine. The circulation of the solution in the frame is not so large because of the pressure loss. The volume of the upper zone for the gas-liquid separation need not so large. However, in the ion-exchange membrane electrolytic cell, the feeding and discharging of the solution is attained in each compartment as described above. The product of the electrolysis is obtained from the upper parts of the compartments. Accordingly, when the frame is used as the frame for the ion-exchange membrane type electrolytic cell, the volume of the solution fed into the upper zone of the frame is increased in the comparison with the conventional asbestos diaphragm method. In order to attain suitable gas-liquid separation, the volume of the upper zone should be large.

From the viewpoint of the strength of the upper zone of the frame, it is necessary to increase the thickness of the frame. Accordingly, when the conventional frames are used as the frames of the ion-exchange membrane type electrolytic cell, the size of the cell should be too large from the viewpoint of the characteristics. The frame should be made of a metal and the weight is too heavy.

SUMMARY OF THE INVENTION:

It is an object of the present invention to provide a filter-press type electrolytic cell having ion-exchange membranes which is easily processed and prepared and can be prepared with low cost and low weight.

It is another object of the invention to provide a filter-press type electrolytic cell which comprises hollow members for path of liquid and gas in which a passage for liquid or gas is formed.

It is the other object of the invention to provide a frame for an filter-press type cell for producing a caustic alkali by an electrolysis of an aqueous alkali metal salt.

The objects of the invention have been attained to provide a filter-press type electrolytic cell which comprises alternatively arranging frames and ion-exchange membranes to form alternatively anolyte compartments and catholyte compartments under fastening the frames wherein said frame comprises hollow member for path of liquid and gas which has inlet or outlet at the outer surface thereof and holes at the inner surface thereof whereby each type of electrolytes is passed into an anolyte or catholyte compartment formed in the frame and the electrolyzed product is discharged from the anolyte or catholyte compartment.

DESCRIPTION OF THE DRAWINGS:

FIGS. 2(*b*) to (*f*) are respectively sectional views of the other embodiments taken along the line A—A in FIG. 1;

FIGS. 3-1, 3-2 and 3-3 are respectively sectional views of the embodiments taken along the line B—B in FIG. 1;

FIG. 4-1 is a schematic view of the electrolytic cell comprising the frames shown in FIGS. 3-1 and 3-2;

FIG. 4-2 is a schematic view of the electrolytic cell comprising the frames shown in FIG. 3-3;

FIGS. 5-1 and 5-2 are respectively sectional views taken along the line C—C in FIG. 4-1;

FIG. 5-3 is a sectional view taken along the line C—C in FIG. 4-2; and

FIG. 6 is a sectional view taken along the line D—D in FIGS. 4-1 or 4-2.

DETAILED DESCRIPTION OF THE EMBODIMENTS

Figure 1:
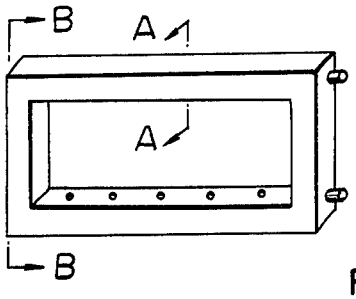
FIG. 1 is a schematic view of a quadrilateral frame comprising a hollow member according to the invention.
Figure 2A:
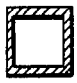
FIG. 2(*a*) is a sectional view of one embodiment taken along the line A—A in FIG. 1.
Figure 2B:
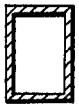
Figure 2C:
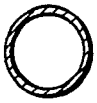
Figure 2D:
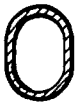
Figure 2E:
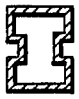
Figure 2F:
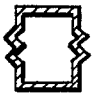

Referring to the drawings, the frame of the invention will be illustrated.

Figures 1, 3:
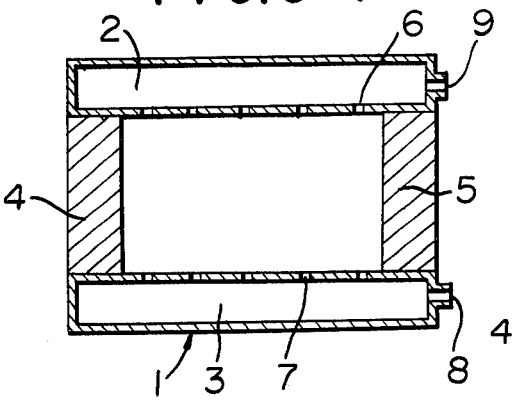
Figures 2, 3:
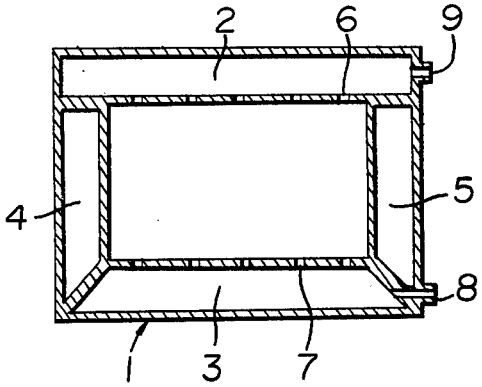
Figure 3:
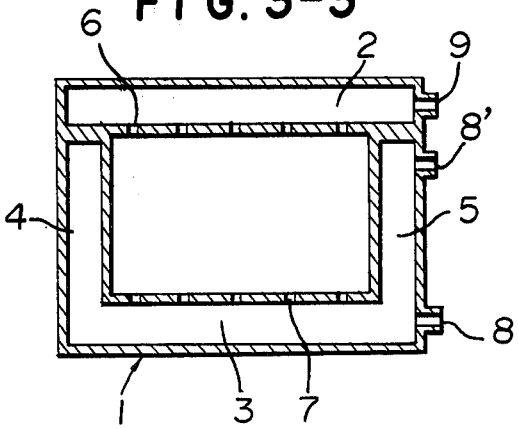

It is preferable to fasten the frames and the ion-exchange membrane through a gasket so as to improve the sealing between the frame and the ion-exchange membrane for the electrolytic cell. The fastening pressure is preferably 1–20 Kg/cm$^2$ especially 2–10 Kg/cm$^2$ by unit area of frame. It is preferable to use hollow members having a regular square sectional view shown in FIG. 2(*a*) as the frames (1) from the viewpoint of easy assemble, though it is possible to use the hollow members having the other sectional views shown in FIGS. 2(*b*) to (*f*). The hollow member shown in FIG. 2(*b*is rectangular sectional view;

The sectional views of the hollow members are FIG. 2(*b*) of rectangule;

FIG. 2(*c*) of circle; and FIG. 2(*d*) of ellipse.

When the section is about round shape as FIGS. 2(*c*) and (*d*), the seal pressure can be centralized to attain high sealing effect in the case of holding the diaphragm through the gasket by the frames.

In the embodiment of FIG. 2(*e*), each groove is formed on each corresponding side surfaces. A gasket of O-ring shape can be disposed in the groove. The diaphragm can be firmly held by putting the diaphragm between the frames and fastening them.

In the embodiment of FIG. 2(*f*), each W shape projected part is formed on each corresponding side surfaces.

It is possible to use the hollow members having the sectional views of FIGs. 2(*b*) to (*f*) as well as FIG. 2(*a*), in combination as desired. It is preferable to form the quadrilaterial frame shown in FIG. 1 from the viewpoint of the strength of frame, the easy assemble, the maintenance of constant concentration in the electrolytic compartment.

When the quadrilaterial frame is formed with four members, it is necessary to use at least two hollow members among four members. In the preparation of the rectangular frame, it is preferable to use the hollow members at least as the upper part and the lower part though the side parts can be only plate or block.

The size of the frame is preferably in a range of 3 m to 0.2 m especially 2 m to 0.5 m of height and 5 m to 0.2 m especially 3 m to 0.5 m of length. The ratio of the height to the length is in a range of 1/5 5/1 . The size of the hollow member is preferably 50 cm to 1 cm especially 20 cm to 3 cm of width in the section. The ratio of the width of the hollow member to the height of the frame is in a range of 1/5 to 1/100.

In FIG. 3-1, one or more holes (7) are formed in the lower hollow member (3) so as to feed the solution into the electrolytic compartment. One or more holes (6) are formed in the upper hollow member (2) so as to discharge the solution from the electrolytic compartment. An inlet (8) is formed on the lower hollow member (3) so as to feed the liquid into the hollow member. An outlet (9) is formed on the upper hollow member (2) so as to discharge the solution from the hollow member. It is enough to form the upper and lower hollow members as the frame.

However, as shown in FIG. 3-2, in order to decrease weight of the frame, it is preferable to form hollow members as the side parts (4) (5) of the frame. The hollow members as the side parts (4), (5) can be formed independently from the upper and lower hollow members without the communication.

In said structure of the frame, the side parts (4), (5) of the frame are hollow members, it is possible to control the temperature of the electrolytic compartment by passing a heating medium or a cooling medium through the hollow members (4), (5).

It is preferable to have the structure of FIG. 3—3, wherein the upper and lower parts (2), (3) and the side parts (4), (5) of the frame are formed by hollow members and the hollow member for the upper part is not communicated to the hollow members for the side parts and the hollow member for the lower part is communicated to the hollow members of the side parts, whereby the weight of the frame can be lowered and the apparatus can be compact for the circulation of the electrolyte described below.

The material of the frame can be selected depending upon the type of the solution and the gas contacted. Typical materials include titanium, and the like for anolyte compartment, and iron, nickel, stainless steel and like for catholyte compartment. It is also possible to use the material of the frame coated with a fluorine type resin such as vinylidene fluoride polymers, tetrafluoroethylene polymers and tetrafluoroethylene-ethylene copolymers.

As stated above, various structures of the frame can be formed by assembling the hollow members.

In order to form the holes for feeding or discharging the solution and the gas, the holes are formed for communicating between the central opening and the hollow member on the inner surface of the hollow member. The work for forming the holes on the surface of hollow member is easily conducted by the conventional method.

In the case of the electrolytic cell having the frames of the invention, as shown in FIGS. 4-1, 4-2 and 6, the frame for catholyte compartment (11) having the cathode (10), the gasket (12), the ion exchange membrane (13), the frame for anolyte compartment (15) having an anode (14) are arranged and the frames are fastened to form the electrolytic compartments of the catholyte compartment (16) and the anolyte compartment (17). The anode is preferably an insoluble electrode such as platinum group metal, a titanium coated with a platinum group metal and a titanium coated with a platinum group metal oxide.

The cathode is preferably made of iron, stainless steel and nickel. The shape of the electrodes can be net shapes (gas generated by electrolysis is not remained), and plate shapes. The diaphragms are cation permeable membranes which have oxidation resistance and chlorine resistance and fluorine-containing polymer type cation-exchange membranes e.g. copolymer of tetrafluoroethylene and sulfonated perfluorovinyl ether; copolymer of tetrafluoroethylene and carboxylated perfluorovinyl ether and the like. The latter cation-exchange membranes are preferably used.

In the case of the diaphragm type electrolytic cell using the cation-exchange membrane, it is possible to insert a spacer between the cation-exchange membrane and the electrode so as to prevent direct contact. The spacer can be chemical resistant material such as a net of polyolefin or florine-containing polymer. The ion-exchange membrane, the spacer and the electrode are held with a packing between the frames.

The electrodes can be disposed in the frames by fixing each electrode leading holder on each frame and each electrode is held on the electrode leading holder.

In the three compartment type electrolytic cell having an intermediate compartment between the anolyte and catholyte compartments, the frame for anolyte compartment having the anode, the diaphragm, the frame for intermediate compartment, the diaphragm and the frame for catholyte compartment having the cathode are arranged in series and are fastened to form the electrolytic cell.

In the case of the monopolar type electrolytic cell, the anolyte compartments and the catholyte compartments are electrically connected in parallel for each electric polarity.

In the feed of the current from the outer power source to the frame, a lead rod is electrically connected to electrodes having the same electric polarity. It is possible to hold the electrodes in the frame through the lead rod by mechanically fixing the lead rod to the electrodes.

The case of monopolar type electrolytic cell has been illustrated.

The bipolar type electrolytic cell can be formed by alternatively arranging the electrodes (one surface of the partition is cathode and the other surface is anode), the frames and the ion-exchange membranes and fastening them. The both frames and the partitions can be welded in one piece.

In the bipolar type electrolytic cell, the frame/anode-cathode/frame is considered as one anode-cathode frame and the frames and the ion-exchange membranes are alternatively arranged and they are fastened.

The anode-cathode frames are connected in series.

In both of the monopolar type and bipolar type electrolytic cells, the upper parts of the frames are respectively connected to gas-liquid separators.

In usually, the anolyte compartments are connected to one or more gas-liquid separator, and the catholyte compartments are connected to the other gas-liquid separator. When an aqueous solution of sodium chloride is electrolyzed, the anolyte compartments are connected to hydrogen gas separator and the catholyte compartments are connected to chline gas separator. These gas separators are disposed out side of frames.

The flow of the solution in the electrolytic cell of FIGS. 4-1 and 4-2 for the electrolysis of an aqueous solution of sodium chloride will be illustrated referring to FIGS. 5-1, 5-2, 5-3 and 6.

Firstly, the flow of the solution in the electrolytic cell using the frames shown in FIGS. 3-1 and 3-2 will be illustrated referring to FIGS. 5-1, 5-2 and 6.

FIGS. 5-1 and 5-2 are respectively sectional views of the electrolytic cell of FIG. 4-1 having the frames of FIGS. 3-1 and 3-2 taken along the line C—C.

FIG. 5-1 shows the structure of the anolyte compartment and the flow of the solution in the compartment.

The catholyte compartment is formed with the same type frames (not shown) as it is clear from FIG. 6 which is a sectional view taken along the line D—D in FIG. 4-1.

The saturated aqueous solution of sodium chloride or the like is fed from the inlet (8) to the hollow zone (3) corresponding to the lower part of the frame (15) for the anolyte compartment (11) and it is passed through the holes of (7) to the anolyte compartment wherein in the electrolysis is conducted to generate $Cl_2$ gas.

The electrolyzed solution rises in the compartment by the gas-lift action with the gas and is passed through the holes (6) to the hollow zone (2) corresponding to the upper part of the frame of the anolyte compartment and the solution containing the gas is discharged through the outlet (9) to out of the frame.

As the same time, in the frame for the catholyte compartment, water or a dilute aqueous solution of sodium hydroxide is fed from the inlet to the hollow zone corresponding to the lower part of the frame and is passed through the holes to the catholyte compartment, wherein the electrolysis is coducted to produce the aqueous solution of sodium hydroxide and to generate hydrogen gas.

The electrolyzed solution rises in the compartment with the gas and is passed through the holes to the hollow zone corresponding to the upper part of the frame (11) and the solution containing the gas is discharged from the outlet.

The gases discharged from the frames of the anolyte compartment and the frames of the catholyte compartments are respectively fed to the gas-liquid separators (18) wherein the gases are separated. Each part of the separated solutions is flowed down through the solution falling pipe (19) to the hollow members (3) in the lower parts of the frames and it is recycled into each of the anolyte compartments or the catholyte compartments.

The gas-liquid separators can be connected to each of frames and they can be connected to a group of the frames of the same type compartments as the common separators. Thus, the concentration of the solution in the frames of the same type compartmemts can be uniform, whereby the condition of the electrolysis in whole of the compartments can be maintained in the optimum condition.

In usual, the gas-liquid separators need enough capacity for forming the gas-liquid intersurface.

In the electrolysis using the ion-exchange membranes and the electrolytes at 80° to 120° C., the phenomenon of formation of a foam layer on the surface of the solution in the gas-liquid separator is found. Accordingly, in our invention, the gas can be easily separated by feeding the electrolyzed solution containing the gas from the above position of the foam layer in the gas-liquid separator. The capacity of the separator for the foam layer of 5–300 mm from the surface of the solution is enough. The capacity of the separator for the foam layer of 20–200 mm from the surface of the solution is more preferable. When the electrolyzed solution is fed below the surface of the solution in the gas-liquid separator, the thickness of the foam layer is too thick, whereby the discharge of the gas is prevented and suitable gas separation can not be attained. In such case, if the foam layer is reduced, a large capacity of the gas-liquid separator is needed. This is not advantageous from the viewpoint of the apparatus.

The position of the gas-liquid separator is the same level of the outlet (9) of the frame for the higher level.

The sectional view of the separator is preferably quadrileral or rectangular shape.

The flow of the solution and the gas in the electrolytic cell shown in FIG. 4-2 using the frames shown in FIG. 3-3, is illustrated referring to FIG. 5-3. In FIG. 5-3, the flow of the solution and the gas in the anolyte compartment is shown. In the catholyte compartment (not shown), the kinds of the electrode and the frames are different but the structure is the same with the anolyte compartment.

The flow of the solution and the gas in the catholyte compartment is the same with that of the anolyte compartment.

The saturated aqueous solution of sodium chloride or like is fed into the hollow zones (3) at the bottoms of the frames (11) of the anolyte compartments in parallel and it is fed through the holes (7) into the anolyte compartments wherein the electrolysis is carried out to generate $Cl_2$ gas. The electrolyzed solution rises with the gas by the gas-lift action and it is fed through the holes (6) into the hollow zone (2) at the upper parts of the frames of the anolyte compartments. The solution containing the gas is fed from the outlet (9) to the gas-liquid separator (18) wherein the $Cl_2$ gas is separated. A part of the separated solution is flowed down through the solution falling pipe and it is fed into the hollow zone (5) of the side parts of the frames. The solution is flowed down through the hollow zone corresponding to the side part of the frame and it is fed into the hollow zone (3) corresponding to the bottom of the frames. The solution is further recycled through the holes to the anolyte compartments, together with the fresh saturated aqueous solution of sodium chloride or like.

At the same time, water is usually fed through the inlet into the hollow zone corresponding to the bottoms of the frames of the catholyte compartments, and it is fed through the holes (7) into the catholyte compartments wherein the electrolysis is carried out to form an aqueous solution of sodium hydroxide and to generate $H_2$ gas. The electrolyzed solution rises with the gas by the gas-lift action and it is fed through the holes into the hollow zone corresponding to the upper parts of the frames of the catholyte compartments. The solution containing the gas is fed from the outlet into the gas-liquid separator wherein $H_2$ gas is separated. A part of the separated solution is flowed down through the solution falling pipe and it is fed into the hollow zone corresponding to the side parts of the frames of the catholyte compartments and it is flowed down and is fed through the hollow zone corresponding to the bottom of the frames into the catholyte compartments together with the fresh water.

In accordance with the present invention, the gas-liquid separation of the electrolyzed solution is carried out in the gas-liquid separator out side of the frames, whereby it is unnecessary to have large capacity for the hollow zone at the upper parts of the frames and the electrolytic cell can be compact. Moreover, the upper and lower parts of the frames and the hollow members for the side parts can be the hollow members having the same sectional size whereby the preparation of the frames can be easy.

The hollow zones corresponding to the upper, lower and side parts of the frame are not respectively communicated whereby the gas in the hollow zone corresponding to the upper part is not flowed into the compartment.

Thus, the side parts of the frame are formed by the hollow member and the hollow zone corresponding to one side part of the frame is communicated to the hollow zone corresponding to the lower part of the frame to form the circulation path of the electrolyte whereby the electrolytic cell can be compact.

The sectional size of the hollow members at the side can be large whereby the pressure loss can be small and the rate of the circulation of the solution which does not contain the gas can be high.

In the electrolytic compartments, the rate of the circulation of the electrolyte is high whereby the ratio of the gas in the solution can be small and the rise of the voltage in the electrolysis caused by the gas can be prevented.

What is claimed is:

1. In a filter-press type electrolytic cell for producing an electrolyzed solution, wherein a plurality of frames are assembled to form alternate anolyte and catholyte compartments separated by an ion-exchange membrane, the improvement comprising:

each of said frames comprising a hollow lower member, a hollow upper member, and side parts separating said hollow upper and lower members, said hollow members and said side parts having inner surfaces which define an interior cell electrolysis zone, said lower and upper hollow members respectively having a frame inlet and a frame outlet on outer cell surfaces thereof, and said lower and upper members also having a plurality of fine holes on said inner surfaces thereof whereby said electrolytic solution enters each frame through said inlet of said lower member, passes through said fine holes in said lower member into said electrolysis zone, is electrolyzed therein, exits said electrolysis zone through said holes in said upper hollow member, and then exits said frame through said frame outlet on the outer surface of said upper hollow member, said side parts not in fluid communication with said lower and upper members.

2. An electrolytic cell according to claim 1 wherein a gas-liquid separator for an electrolyzed solution containing a gas is disposed out of the frames.

3. An electrolytic cell according to claim 1 wherein the side parts of the frame comprise hollow members which are not in fluid communication with said lower and upper members.

4. An electrolytic cell according to claim 1 wherein the frame is made of a metal.

5. An electrolytic cell according to claim 1, further comprising means for feeding the electrolyzed solution into a gas-liquid separator above a foam layer in the separator.

6. In a filter-press type electrolytic cell for producing an electrolyzed solution, wherein a plurality of frames are assembled to form alternate anolyte and catholyte compartments separated by an ion-exchange membrane, the improvement comprising:

each of said frames comprising hollow lower, upper and side members having inner surfaces which define an interior cell electrolysis zone, said lower and side members in fluid communication and having at least one frame inlet on an outer cell surface thereof, said upper member having a frame outlet on an outer cell surface thereof, said lower and upper members having a plurality of fine holes on the inner surfaces thereof, whereby an electrolytic solution enters said frame through said at least one inlet, passes through said fine holes in said lower member into said electrolysis zone, is electrolyzed, and the electrolyzed solution passes through said fine holes in said upper member and exits said frame through said outlet, said upper member not in fluid communication with said lower and side members.

* * * * *

UNITED STATES PATENT AND TRADEMARK OFFICE

CERTIFICATE OF CORRECTION

PATENT NO. : 4,149,952

DATED : April 17, 1979

INVENTOR(S) : Kimihiko Sato et al

It is certified that error appears in the above-identified patent and that said Letters Patent are hereby corrected as shown below:

Please insert the following priority data:
[30] -- April 15, 1975 [JP] Japan ... 50-44776 -- instead of no priority data appearing in the Letters Patent.

Signed and Sealed this

*Fourth* Day of *December 1979*

[SEAL]

*Attest:*

SIDNEY A. DIAMOND

*Attesting Officer*

*Commissioner of Patents and Trademarks*